United States Patent [19]

Reist

[11] Patent Number: 4,901,935

[45] Date of Patent: Feb. 20, 1990

[54] APPARATUS FOR UNWINDING PRINTED PRODUCTS WOUND IN CONJUNCTION WITH A WINDING BAND IN IMBRICATED FORMATION UPON A WINDING CORE

[75] Inventor: Walter Reist, Hinwil, Switzerland

[73] Assignee: Ferag AG, Hinwil, Switzerland

[21] Appl. No.: 196,487

[22] Filed: May 20, 1988

[30] Foreign Application Priority Data

May 27, 1987 [CH] Switzerland ..... 02 044/87

[51] Int. Cl.[4] ..... B65H 18/16; B65H 16/10

[52] U.S. Cl. ..... 242/68.7; 242/59

[58] Field of Search ..... 242/68.7, 59, 78.7, 242/67.3, 55, DIG. 3, 75.1, 56 R

[56] References Cited

U.S. PATENT DOCUMENTS

| | | | |
|---|---|---|---|
| 2,731,213 | 1/1956 | Groll | 242/78.7 |
| 3,223,344 | 12/1965 | Weymouth | 242/78.7 |
| 3,472,463 | 10/1969 | Fedor et al. | 242/78.7 |
| 3,787,001 | 1/1974 | Henry | 242/68.7 X |
| 3,931,940 | 1/1976 | Raighn et al. | 242/56 |
| 4,746,076 | 5/1988 | Tomma et al. | 242/68.7 X |
| 4,775,111 | 9/1988 | Kalin | 242/65 X |

FOREIGN PATENT DOCUMENTS

| | | |
|---|---|---|
| 228151 | 12/1962 | Austria . |
| 0149058 | 7/1985 | European Pat. Off. . |
| 450545 | 10/1927 | Fed. Rep. of Germany . |
| 2207556 | 8/1973 | Fed. Rep. of Germany . |
| 2076500 | 10/1971 | France . |
| 649062 | 4/1985 | Switzerland . |
| 2121771 | 1/1984 | United Kingdom . |

*Primary Examiner*—Daniel P. Stodola
*Assistant Examiner*—Steven M. DuBois
*Attorney, Agent, or Firm*—Willian Brinks Olds Hofer Gilson & Lione

[57] ABSTRACT

The product package composed of a winding core and printed products wound in imbricated formation in conjunction with a winding band upon the winding core, rotatably reposes and while freely supported upon two endless support bands. These support bands are each guided about two rotatably mounted rolls, and predeterminate ones of the rolls are operatively connected with a drive. The winding band is released from the wound package at the region of contact of the wound package with the two endless support bands and this winding band is wound upon a band spool while under a continuous tensional load. The printed products which are released from the product package during the unwinding operation are outfed, for instance, by the support bands and delivered by means of an outfeed conveyor to the next processing station.

17 Claims, 3 Drawing Sheets

APPARATUS FOR UNWINDING PRINTED PRODUCTS WOUND IN CONJUNCTION WITH A WINDING BAND IN IMBRICATED FORMATION UPON A WINDING CORE

BACKGROUND OF THE INVENTION

The present invention relates to a new and improved apparatus for winding, and specifically unwinding of printed products which have been previously wound in conjunction with a winding band or strap—also referred to in the art as a winding tape—in imbricated or shingled formation upon a winding core or mandrel or the like.

Generally speaking, the apparatus for the unwinding of printed products which have been previously wound up in conjunction with a winding band and/or strap in imbricated or shingled formation upon a winding core or mandrel or the like, comprises a support arrangement or support means for the product package, a rotatably mounted and drivable band spool or spool member for winding up the winding band or strap which has been unwound from the product package, and a continuous conveyor or conveyor means for the outfeed or delivery of the unwound imbricated formation of printed products.

Such type of apparatus is known, for instance, from the European Published Patent Application No. 0,142,745, and the corresponding U.S. Pat. No. 4,597,541, granted July 1, 1986, entitled "APPARATUS FOR UNWINDING PRINTED PRODUCTS WOUND UP IN AN IMBRICATED FORMATION". With this heretofore known construction of apparatus, the winding core is rotatably mounted at a stationary support or bearing arrangement. For the outfeed of the unwound imbricated formation of printed products, a continuous conveyor can be positionally adjusted in relation to the product package or the winding core, as the case may be. With this prior art arrangement it is necessary to construct the continuous conveyor such that the printed products are positively outfed or delivered throughout the different positions which can be assumed by the continuous conveyor during the course of the product unwinding operation. To fulfill this requirement there is needed a complicated construction of the continuous conveyor. Equally, with this state-of-the-art apparatus, the product package must be slipped onto a support or bearing shaft or the like before it can be placed upon the support or bearing arrangement. This again requires the utilization of appropriate equipment.

Continuing, in German Patent No. 2,207,556, published Oct. 24, 1974, there is disclosed a further construction of apparatus for the unwinding of printed products are clamped in imbricated or shingled formation between two winding bands, specifically a pair of winding bands, and then wound up upon a drum. During unwinding of the printed products stored upon the drum the pair of winding bands are payed-off the drum in conjunction with the printed products. Both of the winding bands divergingly travel, after having emptied their product contents at an outfeed conveyor, to individual separate storage rolls. The imbricated product formation is outfed by the pair of winding bands in approximately horizontal direction from the product package. Moreover, the entire drum is elevationally positionally shifted in order to compensate for the rather thick wound-up layers or coils of the printed products. This unwinding apparatus is not suitable for unwinding printed products which have been wound in imbricated formation upon a winding core with only one winding band, because such printed products are outfed in so-to-speak overfeed or from above in relation to the product package and the winding core, as the case may be. Equally, with this prior art apparatus it is necessary that the drum together with the product package which has been wound up upon the drum hub, and which product package can possess an appreciable weight, be upwardly moved by virtue of the decreasing thickness or size of the product package in order that the wind-off site or point for the printed products be located at the same elevational position.

SUMMARY OF THE INVENTION

Therefore, with the foregoing in mind it is a primary object of the present invention to provide a new and improved construction of an unwinding apparatus of the character described which is not afflicted with the aforementioned drawbacks and limitations of the prior art constructions.

Another and more specific object of the present invention is directed to a new and improved construction of an unwinding apparatus for unwinding essentially flat products or structures, such as printed products and the like, which have been previously wound-up in imbricated or shingled formation on a winding core in conjunction with a winding band or strap in order to form a product package or wound package, in a manner which is not afflicted with the aforementioned shortcomings.

A further important object of the present invention aims at the provision of a new and improved construction of unwinding apparatus of the previously mentioned type which possesses a simplified construction and can be more easily and simply handled.

Still a further important object of the present invention is directed to an improved construction of an unwinding apparatus for substantially flat products or structures, such as printed products, which unwinding apparatus is relatively simple in construction and design, quite economical to manufacture, highly reliable in operation, not readily subject to breakdown and malfunction, and requires a minimum of maintenance and servicing.

Now in order to implement these and still further objects of the invention, which will become more readily apparent as the description proceeds, the unwinding apparatus of the present development is manifested, among other things, by the features that the support arrangement or support means comprises at least one endless revolving drivable support band or belt member which is guided about at least two rotatably mounted rolls or rollers. The product package or wound package is rotatably supported upon the aforementioned at least one endless revolving drivable support band or belt, and the supporting active-run of such endless revolving drivable support band or belt possesses a throughhang or hang-through when the product package or winding core reposes upon the supporting active-run of the support band or belt.

Since the product package is mounted to be rotatable and freely supported upon an endless support band or belt or equivalent structure, it is no longer necessary to use a support or bearing shaft and a support or bearing arrangement for such support or bearing shaft. The product package can be merely placed upon the support bands or belts and it is no longer necessary that the product package be inserted upon the support or bearing shaft with the aid of appropriate supplementary devices or equipment as was heretofore required.

The aforementioned rolls or rollers are rotatably mounted upon shafts which are preferably stationarily arranged at a frame or equivalent structure. With this construction, each employed support band or belt either possesses a certain elasticity so that its supporting active-run can be elongated or extended in length by the weight of the product package or wound package placed thereupon and such product package assumes a stable position between both of the rolls or rollers, or each employed support band is loosely placed about the associated rolls or rollers in its unloaded state, so that the return run of the support band can be tensioned whereas the supporting active-run hangs through due to the weight of the product package.

According to a preferred embodiment of the unwinding apparatus of the present development a roll or roller is rotatably mounted at a shaft which is stationarily arranged at the frame or frame means, whereas the other shaft is arranged so that it can alter its position or posture in horizontal direction. In this way, there is achieved the result that a support band or belt having very little elasticity also can assume a defined position in the unloaded state thereof, and upon loading of the support band by the product package or the empty winding core, the positionally shiftable shaft of shaft member can displace to such an extent toward the stationary shaft or shaft member that the supporting active-run of the support band is downwardly pressed by the weight of the product package or the winding core, as the case may be, to such an extent that the product package or the winding core likewise assumes a stable position between both of the rolls or rollers. Furthermore, with this constructional embodiment, the throughhang or hanging through of the supporting active-run can be regulated with decreasing package weight, so that the product package still assumes a stable position between the rolls or rollers even towards the end of the unwinding operation.

In order to increase the operating safety of the unwinding apparatus and its operational reliability and to preclude a lateral jumping-off of the product package from the support band or belt, the product package is mounted upon the support band between lateral guides or guide members which are arranged essentially parallel to the support band.

In accordance with a particularly simple and preferred construction of the unwinding apparatus of the present development, the product package is supported upon two substantially parallelly extending support bands or belts which are in spaced relationship from one another. With this arrangement, the winding band or strap is not clamped between the support bands and the product package or wound package, and this arrangement increases the stability of the product package and renders possible a free outfeed or delivery of the winding band or strap.

In a design of the unwinding apparatus which affords a very rapid acceleration and renewed braking of the product package or wound package, the support band or the support bands, if a plurality of support bands are used, are operatively connected with the drive or drive means. The band spool or spool member is driven by the same drive or drive means in such a manner that a slip coupling or clutch or equivalent structure arranged between the band spool or spool member and the drive means can ensure that the winding band is subjected to a continuous tensional load or tension.

According to a particularly simple and suitable development of the unwinding apparatus of the present invention, the band spool is mounted beneath the supporting active-run of the support bands. The winding band intersects the supporting active-runs before the printed products, as viewed in the product conveying direction, detach or release from the product package. As a result, the printed products which are unwound from the product package, after having separated from the product package, come to lie upon the support bands or belts and are then outfed or delivered away from the product package by such support bands or belts.

In order to further enhance the operational safety of the unwinding apparatus, according to a further advantageous constructional embodiment, there is provided a limiting means or structure which is effective at the winding core or core member in the direction of the support band or bands. This limiting structure prevents a rolling-off of the product package from the support band or bands even if the support band or bands in their unloaded state are appreciably tensioned and the axes or shafts of the rolls are not displaceably mounted and if there should occur appreciable acceleration or deceleration forces.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
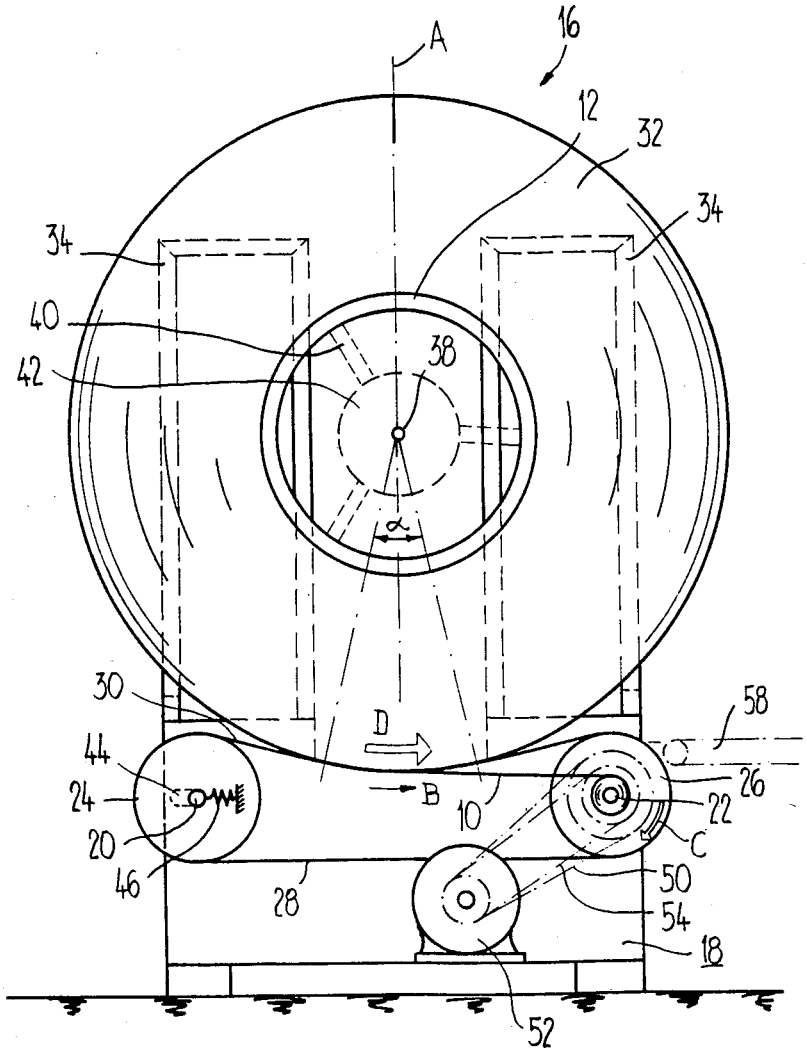
FIG. 1 is a side view of an exemplary embodiment of unwinding apparatus constructed according to the present invention and depicting a full product package or wound package, wherein the front portion of the frame of such unwinding apparatus has not been illustrated to enhance the showing of the drawings.

Describing now the drawings, it is to be understood that to simplify the illustration of the unwinding apparatus, only enough of the construction thereof has been illustrated therein as is needed to enable one skilled in the art to readily understand the underlying principles and concepts of this invention. Turning attention now specifically to FIG. 1, there is depicted therein by way of example and not limitation, an exemplary embodiment of unwinding apparatus 16 for the unwinding of flat or superficial products or structures, such as typically printed products 14 previously wound in conjunction with a winding band or strap 10 in imbricated formation S upon a winding core or core or mandrel member 12. It will be understood that the printed products 14 are unwound from the product package or wound package 32 in conjunction with the winding band or strap 10 so as to likewise appear in an imbricated formation S. Such type of product package or wound package 32 has been disclosed in detail in Swiss Patent No. 642,602, ad the corresponding U.S. Pat. No. 4,438,618, granted Mar. 27, 1984, entitled "APPARATUS FOR STACKING PRINTED PRODUCTS, SUCH AS NEWSPAPERS, PERIODICALS AND THE LIKE, ARRIVING IN AN IMBRICATED PRODUCT STREAM", to which reference may be readily had the disclosure of which is incorporated herein by reference.

At a frame or frame member 18 or equivalent structure there are stationarily arranged two shaft or shaft members 20 and 22. At each shaft 20 and 22 there are rotatably mounted two associated rolls or rollers 24 and 26, as best seen by referring to FIGS. 1 and 2. As will also be evident a tangent applied as an upper common tangent to the rolls 24 and 26 extends substantially in horizontal direction. A respective support element, specifically an endless support band or belt 28 and 28' or equivalent support element is guided in each case about two coacting rolls or rollers 24 and 26. At the upper runs 30 of such support bands or belts 28 and 28' there reposes the product package or wound package 32 composed of the winding core or core member 12, the wound-up printed products 14 and the likewise wound-up winding band or strap 10. The product package 32 which bears upon such upper support band-runs, constituting the supporting active-runs of the support bands 28 and 28', is disposed thereupon so as to be freely rotatable and is not further supported. Under the weight of the product package 32, the supporting active-runs 30 tend to hang through, so that they extend in ascending fashion towards both of the rolls or rollers 24 and 26 as particularly evident by referring to FIG. 1.

The product package 32 or the like is enclosed by the support bands or belts 28 and 28' throughout the wrap angle $\alpha$. At both sides of the product package 32 there are arranged guides or guide members 34 which are secured at the frame or frame member 18, as best seen by referring to FIG. 2. These guides or guide members 34 each consist of tubular profiles or sectional elements and are structured, for instance, as rectangular frames or frame units. Between the end or side faces or walls 36 of the product package 32 and the guides and guide members 34, there is provided a small air gap, so that the product package 32 can freely rotate 38 without the product package 32 coming into contact with the guides or guide members 34. At each end or side face or wall 36 of the product package 32, the guides or guide members 34 are arranged in pairs symmetrically with respect to a vertical plane A taken through the axis of rotation 38 of the product package or wound package 32.

The guides or guide members 34 of each pair are spaced at such a distance from one another that the winding core or mandrel 12 positively always comes to lie between two oppositely situated guides or guide members 34. The guides or guide members 34 prevent a lateral drift or running-off of the product package 32 from the support bands or belts 28 and 28' in the event that, for whatever reason, the product package 32 should shift or move away from the center. The guides or guide members 34 also, however, reduce the risk of accidents for the operating personnel since these guides or guide members reduce the danger that an operator will come into contact with the rotating product package 32 which does revolve at a rather rapid speed or velocity.

Figure 2:
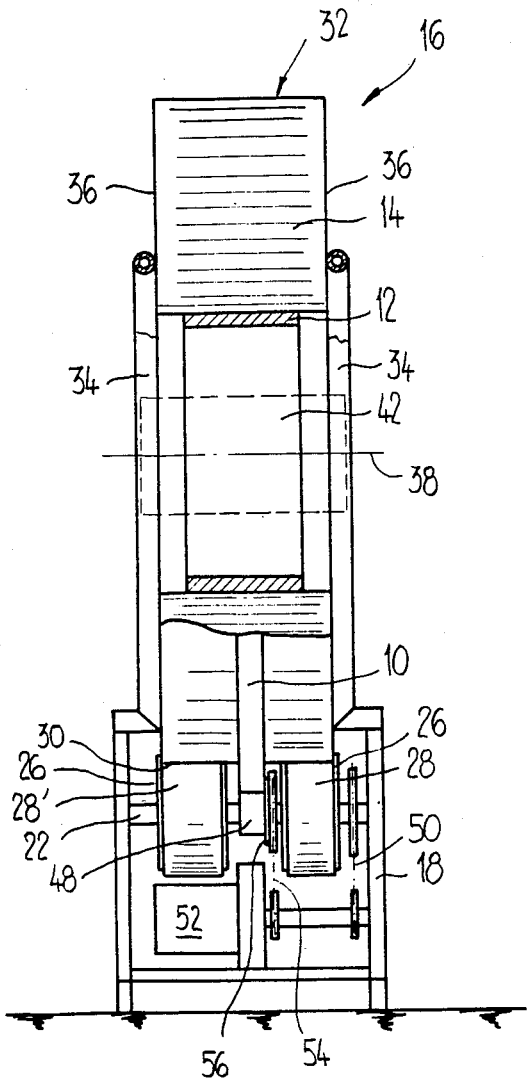
FIG. 2 is an end view, shown partially in section, of the unwinding apparatus depicted in FIG. 1.

A measure which further increases the operational safety of the unwinding apparatus has been depicted in broken lines in FIGS. 1 and 2. It will be observed that a travel limiting structure or facility, here constituted by stub shaft 42 provided with the spokes 40, is supported at the winding core or core member 12. From the illustration of FIG. 2, it will be apparent that the stub shaft 42, shown in broken lines in such FIG. 2, protrudes laterally beyond the end or side faces or surfaces 36 of the product package 32 and comes to lie between each two respective ones of the symmetrically arranged guides or guide members 34. A rolling-off of the product package from the supports bands or belts 28 and 28' in the direction of belt travel is thus also effectively prevented. Limitation of the permissible displacement of the product package 32 in the direction of the support bands or belts 28 and 28' also can be, of course, accomplished in a different fashion than the exemplary structure depicted herein and discussed heretofore.

It is possible to dispense with the safety feature employing the stub shaft 42 or a further limiting structure if there is ensured for a sufficiently large throughhang of the upper or supporting-active run 30 owing to the weight of the product package or wound package 32 or simply the winding core or core member 12. As previously described, the shaft or shaft members 20 and 22 are stationarily arranged at the frame or frame member 18. If there are used endless support bands 28 and 28' having very modest elasticity properties, then it is necessary that the support bands 28 and 28' in their unloaded state, be guided in a loose condition about the associated rolls or rollers 24 and 26. These support bands 28 and 28' then will first snugly bear against the associated rolls or rollers 24 and 26 under the weight of the winding core 12 or under the total weight of the product package or wound package 32 and thus ensure for the requisite throughhang of the supporting active-run 30 of each of the support bands 28 and 28'. During such throughhang of the supporting active-run 30 of each of the support bands 28 and 28' the return run of each of the support bands 28 and 28' will be tensioned. On the other hand, if there are used elastic support bands 28 and 28', then the latter, also in the unloaded state of such support bands 28 and 28', can bear with a pre-load at the rolls or rollers 24 and 26.

Due to the weight of the winding core 12 and the product package 32 the support bands 28 and 28' are elongated. In this way, there can be obtained an adequate throughhang of the support bands or belts 28 and 28'. A further possibility for achieving this result is depicted in broken lines in FIG. 1. It will be observed that the shaft 20 is mounted in substantially horizontal lengthwise guides or guide members 44 at the frame 18. A biasing element, here shown as a compression or pressure spring 46, ensures that the support bands 28 and 28' are always tensioned also in the unloaded condition or state of the support bands 28 and 28'. When the support bands 28 and 28' are loaded by the winding core 12 or the product package 32, which also then obviously includes the winding core 12, the compression spring 46 is compressed and the shaft 20 impacts at the right-hand end of the lengthwise guide 44 of FIG. 1 at which there is located the compression spring, or better stated, the compression springs 46, when it is understood that a similar arrangement is provided for the other support band 28' not visible in the showing of FIG. 1. The weight of the product package 32 or the winding core 12, as the case may be, thus causes a movement or displacement of the rolls 24 in the direction towards the other rolls 26.

By referring to FIG. 2 it will be particularly seen that between the two rolls 26 which are arranged upon the associated shaft or shaft member 22, there is arranged the band spool or spool member 48 which serves to wind-up the winding band or strap 10 which has been unwound from the product package 32. The rolls or rollers 26 conjointly rotate with the shaft 22 and this shaft 22 is rotatably mounted in any appropriate fashion, for instance in bearings, at the frame 18. The shaft 2 is operatively or drivingly connected by means of, for instance, a chain drive 50 with a drive unit or drive motor 52. It will of course be understood that in place of the chain drive 50, there can be used, as is generally known, a gear or belt drive. The drive or drive unit or motor 52 is operatively or drivingly connected by means of a second chain drive 54 with a slip coupling or clutch 56 or equivalent structure. The power take-off of the slip coupling 56 is operatively or drivingly connected with the band spool 48. From the showing of FIG. 1, it will be recognized that by virtue of the different speed transmissions of the chain drives 50 and 54, the band spool or spool member 48 is driven with a larger rotational speed or velocity than that of the rolls or rollers 26. The mode of operation of the drive structure will be more fully explained hereinafter.

At this point it is remarked that in the direction of movement B of the upper or supporting-active run 30 of each of the support bands 28 and 28', there is arranged after the rolls or rollers 26 an outfeed or delivery conveyor 58 or the like. This outfeed or delivery conveyor 58 may be constituted by a conventional band or belt conveyor.

Having now had the benefit of the foregoing discussion of the unwinding apparatus 16 for unwinding product packages or wound packages 32, its mode of operation will now be considered and is as follows:

A fully wound product package 32 is placed upon the upper or supporting-active runs 30 of the support bands or belts 28 and 28'. Placement of the fully wound product package 32 upon the support bands 28 and 28' can be accomplished by conventional conveyor or material handling machines or equipment, such as cranes or forklift trucks. In the event that the wound package 32 is placed from the side or introduced laterally onto the support bands 28 and 28', for instance from the side of the support band 28, then for this purpose the lateral guides or guide members 34 at the frame 18 are either removed or appropriately shifted or pivoted out of the region where the full product package 32 is introduced. Since the product package 32 comes to lie between the rolls or rollers 24 and 26 and, in the manner explained above, measures have been undertaken to ensure that due to the loading of the support bands 28 and 28' by the product package 32 a throughhang or hanging through of the support bands 28 and 28' is accomplished, the product package 32 assumes a stable position at the central or intermediate region between the spaced rolls or rollers 24 and 26. The product package 32 never comes to bear directly upon the rolls or rollers 24 and 26, rather this product package 32 always lies between these rolls or rollers 24 and 26 only upon the support bands 28 and 28'. Thereafter, the guides or guide members 34 are again mounted upon the frame 18 or if shifted or pivoted then shifted or pivoted back into their original position. However, it is also possible to place the product package or wound package 32 from above onto the support bands or belts 28 and 28'. In that case, it is not necessary to remove or otherwise manipulate the guides or guide members 34. In any event, the product package 32 is positioned upon the support bands or belts 28 and 28' in such a manner that the outer end of the winding band 10 is moved away in the direction of movement B of the upper or supporting-active run 30 of each of the support bands 28 and 28' and is then secured to the band spool or spool member 48.

The torque or rotational moment of the now turned-on drive or drive unit 52, constituted by any suitable drive motor, is transmitted by means of the chain drives or drive means 50, 54 to the shaft 22, the rolls or rollers 26 and the support bands 28 and 28' as well as to the band spool or spool member 48. The direction of rotation of the rolls 26 has been conveniently designated by reference character C in FIG. 1. Since the product package 32 is placed so as to be freely rotatable upon the support bands 28 and 28' and causes a throughhang of the upper or supporting-active runs 30 of the support bands or belts 28 and 28' due to the inherent weight of such product package 32, the position of the product package 32 between the rolls or rollers 24 and 26 is defined. The product package 32 thus rotates in the direction of the arrow D of FIG. 1 with the same unwinding velocity as the velocity of movement of the upper or supporting-active run 30 of each of the support bands or belts 28 and 28' which move in the direction of the arrow B depicted in FIG. 1. Since the speed or velocity transmission of the chain drive 54 is greater than that of the chain drive 50 the winding band or strap 10 or the like is always retained under a defined tension or tensional load by means of the slip coupling or clutch 56 or equivalent structure. As will be apparent by referring to FIGS. 1 and 3, the winding band 10 is released or detached at the central region between the rolls and rollers 24 and 26, within the wrap or enclosure angle $\alpha$, from the product package 32 and intersects the supporting active-runs 30 of the support bands or belts 28 and 28'. The printed products 14 which have been wound in imbricated formation S upon the winding core or core or mandrel member 12 separate or detach from the product package 32 shortly after the aforementioned release or detachment of the winding band or strap 10 and come to bear upon the upper or supporting-active runs 30 of the support bands or belts 28 and 28'.

The thus unwound printed products 14 or the like are then outfed by means of the support bands or belts 28 and 28' away from the product package 32 until arriving at the region of the rolls or rollers 26. At that location, the printed products 14 are transferred to the outfeed or delivery conveyor 28 which then further conveys such printed products 14 to the next processing station or other suitable location. The varying rotational speed difference between the rolls 26 which rotate with approximately constant rotational speed and the band spool 48 which becomes continuously larger in size in conjunction with the continuously wound-up winding band or strap 10 is compensated by the action of the slip coupling or clutch 56. The winding band 10 is continuously subjected to an approximately constant tension or tensional stress or load.

Figure 3:
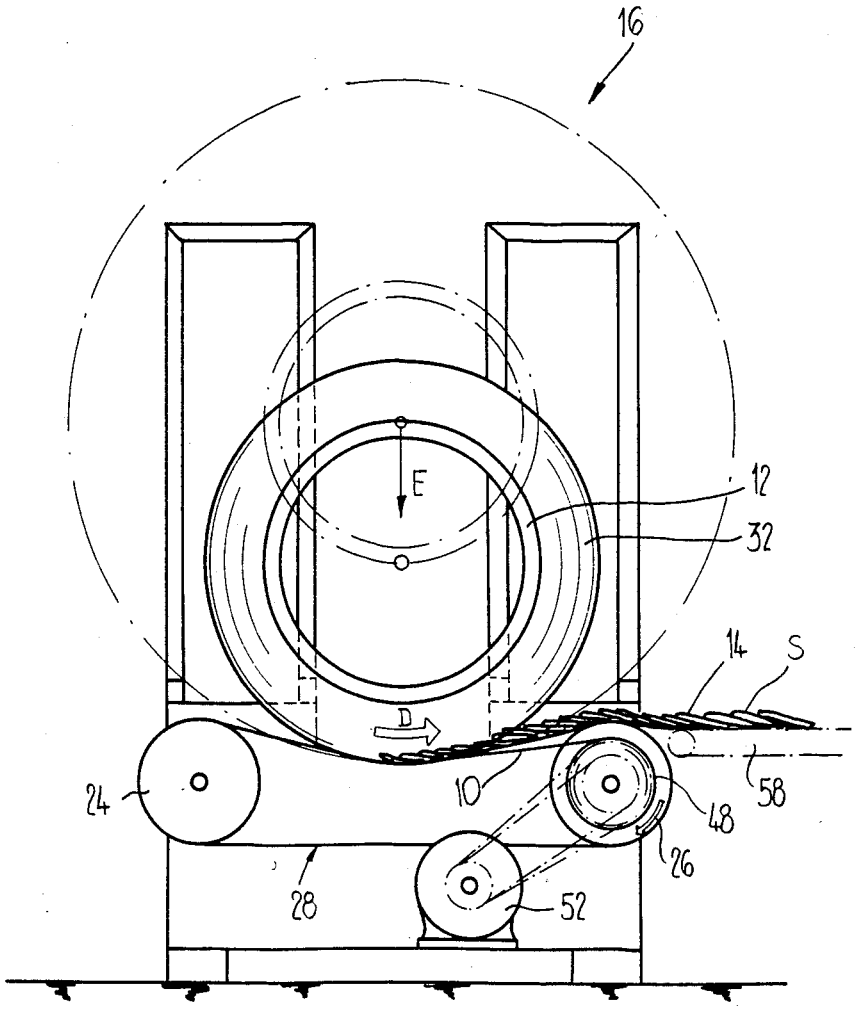
FIG. 3 is an illustration similar to the showing of FIG. 1 of the unwinding apparatus, however with the product package for the most part having been unwound or depleted.

In FIG. 3 there has been depicted with a chain-dot line the sides of the full or the completely wound printed product package or wound package 32. Due to the unwinding of the printed products 14 from the winding core or core member 12, the latter moves downwardly in the direction of the arrow E and continuously approaches the upper or supporting-active run 30 of each of the support bands or belts 28 and 28' until finally all of the printed products 14 are outfed. The end of the winding band or strap 10 or the like is now released or disconnected from the winding core 12. This winding core 12 is thus available for again winding-up thereupon new printed products 14 at a suitable wind-up station or location, as is well known in this technology. The shaft or shaft member 22 possesses at the region of the band spool or spool member 48 a de-couplable shaft section or portion. To exchange a full band spool 48 for an empty band spool, the full band spool 48 is disconnected from the slip coupling or clutch 56 and removed in conjunction with the wound-up winding band or strap 10 from the shaft section, whereupon an empty band spool 48 can be mounted in reverse sequence. This is also possible in the event that the band spool or spool member 48 is rotatably mounted at a separate rotary shaft which is arranged at the frame or frame member 18. The end of the winding band 10 which is located close to the winding core 12 can also be allowed to remain attached with the winding core 12 and thus the winding spool 48 about which there has been wound the winding band or strap 10 is then freely available in conjunction with the winding core 12, or else the winding band 10 is separated from the winding core 12, in which case the full band spool or spool member 48 is separately freely available.

With the exemplary embodiment of the inventive unwinding apparatus depicted in FIGS. 1 to 3, the support elements, namely the support bands 28 and 28' assume the function of a continuous conveyor for the outfeed of the unwound imbricated formation S of printed products 14 which have been unwound from the product package or wound package 32 and for delivery of such printed products 14 to the outfeed or delivery conveyor 58. However, it is also completely conceivable to design the unwinding apparatus such that the winding core or core member 12 is rotatably and freely supportedly mounted upon the endless support bands 28 and 28' and the unwound printed products 14 are then outfed or outwardly delivered from the product package 32 by means of a separate continuous conveyor or conveyor means.

It is also possible to only drive the band spool or spool member 58 by means of the drive unit or drive 52. The drive of the product package 32 and the support bands 28 and 28' is now only accomplished by means of the winding band 10; this winding band 10 transmits the drive power from the band spool 48 to the product package 32 which rolls upon the free or slightly braked and movable support bands or band members 28 and 28'.

While there are shown and described present preferred embodiments of the invention, it is to be distinctly understood that the invention is not limited thereto, but may be otherwise variously embodied and practiced within the scope of the following claims.

Accordingly, what I claim is:

1. An unwinding apparatus for unwinding printed products wound in conjunction with a winding band in imbricated formation upon a winding core, comprising:

support means for supporting the product package wound upon the winding core;

a rotatably mounted and drivable band spool for winding-up the winding band unwound from the product package;

a continuous conveyor for the outfeed of the unwound imbricated formation of printed products;

said support means comprising at least one endless, revolvingly drivable support band;

at least two rotatably mounted rolls;

said at least one endless revolvingly drivable support band being guided about said at least two rotatably mounted rolls;

the product package to be unwound being rotatably supportable upon said at least one endless revolvingly drivable support band;

said at least one endless revolvingly drivable support band having a supporting active-run; and said supporting active-run of said at least one endless revolvingly drivable support band possessing a throughhang upon placement of the product package or the winding core upon said supporting active-run.

2. The unwinding apparatus as defined in claim 1, further including:

frame means;

a rotatable shaft provided for each rotatably mounted roll;

each said shaft being arranged at said frame means so as to be non-displaceable in relation to said frame means; and each rotatably mounted roll being rotatably mounted at an associated one of said shafts.

3. The unwinding apparatus as defined in claim 1, further including:

at least one shaft at which there is mounted at least one of said rotatably mounted rolls; and means mounting said at least one shaft for movement in substantially horizontal direction.

4. The unwinding apparatus as defined in claim 1, further including:

two guide means for lateral guiding of the product package when placed upon said at least one endless revolvingly drivable support band;

said two guide means extending in essentially parallel relationship with respect to said at least one endless revolvingly drivable support band; and said two guide means straddling therebetween said at least one endless revolvingly drivable support band.

5. The unwinding apparatus as defined in claim 1, wherein:

said at least one endless revolvingly drivable support band comprises two support bands, each having a supporting-active run, and upon which there is supported said product package; and said two support bands extending substantially parallel to one another and in spaced relationship with respect to one another.

6. The unwinding apparatus as defined in claim 5, wherein:

said at least two rotatably mounted rolls comprise at least two rotatably mounted rolls for each of said support bands;

each support band being guided about two associated ones of said rotatably mounted rolls defining a respective pair of rolls; and means for rotatably mounting said band spool between the two pairs of rolls provided for the two support bands.

7. The unwinding apparatus as defined in claim 1, further including:

common drive means for driving said at least one endless revolvingly drivable support band and said drivable band spool for the winding band.

8. The unwinding apparatus as defined in claim 1, further including:

drive means for driving said drivable band spool; and said at least one endless revolvingly drivable support band comprises a freely movable support band.

9. The unwinding apparatus as defined in claim 1, further including:

drive means for driving said drivable band spool such that said at least one endless revolvingly drivable support band constitutes a braked but movable support band.

10. The unwinding apparatus as defined in claim 7, further including:

slip coupling means acting upon said drivable band spool;

said slip coupling means being effective between said common drive means and said drivable band spool; and said slip coupling means driving said drivable band spool such that the winding band is wound-up upon the drivable band spool under approximately constant tension.

11. The unwinding apparatus as defined in claim 5 wherein:

said drivable band spool is arranged beneath the supporting active-runs of each of said support bands so that said winding band intersects said supporting active-runs in the region defined between the sections where said product package is in contact with said support band.

12. The unwinding apparatus as defined in claim 1, wherein:

said supporting active-run of said at least one endless revolvingly drivable support band has a predeterminate direction of movement;

an outfeed conveyor for outfeeding the printed products from said at least one endless revolvingly drivable support band; and said outfeed conveyor being arranged in the predeterminate direction of movement of the supporting active-run of the at least one endless revolvingly drivable support band.

13. The unwinding apparatus as defined in claim 12, wherein:

said outfeed conveyor comprises a band conveyor.

14. The unwinding apparatus as defined in claim 1, further including:

limiting means for limiting displacement of the winding core and the wound package wound thereupon; and said limiting means being effective at the winding core in the direction of the at least one endless revolvingly drivable support band.

15. The unwinding apparatus as defined in claim 1, wherein:

said supporting active-run, with the product package placed upon said at least one endless revolvingly drivable support band, ascending towards said at least two rotatably mounted rolls.

16. An unwinding apparatus for unwinding printed products wound in conjunction with a winding band in imbricated formation upon a winding core, comprising:

support means for supporting the product package wound upon the winding core;

a rotatable mounted and drivable band spool for winding-up the winding band unwound from the product package;

a continuous conveyor for the outfeed of the unwound imbricated formation of printed products;

said support means comprising at least one endless, revolvingly drivable support band;

at least two rotatably mounted rolls;

said at least one endless revolvingly drivable support band being guided about said at least two rotatably mounted rolls;

the product package to be unwound being rotatably supportable upon said at least one endless revolvingly drivable support band; said at least one endless revolvingly drivable support band having a supporting active-run;

said supporting active-run of said at least one endless revolvingly drivable support band possessing a throughhang upon placement of the product package or the winding core upon said supporting active-run;

guide means for lateral guiding of the product package when placed upon said at least one endless revolvingly drivable support band;

said guide means extending in essentially parallel relationship to said endless revolvingly drivable support band;

said guide means straddling therebetween said at least one endless revolvingly drivable support band; and limiting means for limiting displacement of the winding core and the wound package wound thereon, said limiting means comprising a tub shaft protruding past the product package;

said stub shaft being inserted into the winding core; and said stub shaft being slidingly guided in substantially vertical direction at said guide means.

17. An unwinding apparatus for unwinding substantially flat products wound in conjunction with a winding band in imbricated formation upon a winding core, comprising:

support means for supporting the product package wound upon the winding core;

a rotatably mounted and drivable band spool for winding-up the winding band unwound from the product package;

means for the outfeed of the unwound imbricated formation of substantially flat products;

said support means comprising at least one drivable support element;

the product package to be unwound being rotatably supportable upon said at least one drivable support element;

said at least one drivable support element having a supporting portion; and said supporting portion of said at least one drivable support element possessing a throughhang upon placement of the product package or the winding core upon said supporting portion of said at least one drivable support element.

* * * * *

UNITED STATES PATENT AND TRADEMARK OFFICE

CERTIFICATE OF CORRECTION

PATENT NO. : 4,901,935

DATED : February 20, 1990

INVENTOR(S) : Walter Reist

It is certified that error appears in the above-identified patent and that said Letters Patent is hereby corrected as shown below:

In column 1, line 55, after "products" please insert --. With this unwinding apparatus, the printed products--.

In column 5, line 5, after "642,602," please delete "ad" and substitute therefor --and--.

In column 5, line 47, after "rotate" please insert -- upon the support bands 28 and 28' about its axis of rotation--.

In column 7, line 11, after "shaft" please delete "2" and substitute therefor --22--.

Signed and Sealed this

Twenty-second Day of December, 1992

*Attest:*

DOUGLAS B. COMER

*Attesting Officer*

*Acting Commissioner of Patents and Trademarks*